US006176226B1

(12) United States Patent
Nines et al.

(10) Patent No.: US 6,176,226 B1
(45) Date of Patent: Jan. 23, 2001

(54) CONTROL METHOD AND APPARATUS FOR A HEATED TIP INJECTOR

(75) Inventors: Jerry Edward Nines; Frank Zimmerman, both of Newport News; Danny Orlen Wright, Cobb's Creek, all of VA (US)

(73) Assignee: Siemens Automotive Corporation, Auburn Hills, MI (US)

( * ) Notice: Under 35 U.S.C. 154(b), the term of this patent shall be extended for 0 days.

(21) Appl. No.: 09/340,107

(22) Filed: Jun. 25, 1999

Related U.S. Application Data

(60) Provisional application No. 60/108,574, filed on Nov. 16, 1998.

(51) Int. Cl.[7] ..... F02M 31/02
(52) U.S. Cl. ..... 123/549
(58) Field of Search ..... 123/549, 557, 123/179.21

(56) References Cited

U.S. PATENT DOCUMENTS

| | | | | |
|---|---|---|---|---|
| 3,868,939 | * | 3/1975 | Friese et al. | 123/549 |
| 4,627,405 | * | 12/1986 | Imhof et al. | 123/549 |
| 4,870,932 | * | 10/1989 | Asmus | 123/179.21 |
| 5,050,569 | * | 9/1991 | Beunk et al. | 123/549 |
| 5,529,035 | * | 6/1996 | Hunt et al. | 123/179.21 |

FOREIGN PATENT DOCUMENTS

| | | |
|---|---|---|
| 4431189 | 3/1996 | (DE) . |
| 19745496A1 | 4/1998 | (DE) . |

* cited by examiner

*Primary Examiner*—Marguerite McMahon

(57) ABSTRACT

A method and apparatus for controlling a heated tip injector having a connector with more than two pins. In one embodiment, the method includes (a) providing a plurality of heated tip injectors each having a coil and an internal heater; (b) maintaining all the internal heaters in an OFF state while the engine is cranking; (c) maintaining an internal beater in an OFF state if any of the coils are ON; and (d) maintaining an internal heater in an ON state if the engine is not cranking and all the internal heater coils are OFF. One embodiment of the apparatus includes a plurality of heated tip injectors each having a coil and an internal heater; a power supply; an ignition switch connected to the power supply, one end of each coil and heater being connected together and to the ignition switch; an engine electronic control unit, another end of each coil being connected to the engine electronic control unit; means for switching each internal heater ON and OFF, another end of each internal heater being connected through a respective means for switching to ground; a crank circuit including a crank for cranking the engine; and means for isolating the crank circuit from the engine electronic control unit.

4 Claims, 8 Drawing Sheets

CONTROL METHOD AND APPARATUS FOR A HEATED TIP INJECTOR

This application claims the benefit of priority from provisional patent application serial No. 60/108,574 filed Nov. 16, 1998.

BACKGROUND OF INVENTION

The invention relates in general to heated tip injectors and in particular to a method and apparatus for controlling heated tip injectors.

In general, a heated tip fuel injector comprises an electric heater in the fuel path within an injector valve body. Examples of heated tip fuel injectors are described in U.S. patent application Ser. No. 09/088,126 entitled "Method of Preheating Fuel with an Internal Heater" filed on Jun. 1, 1998; U.S. patent application Ser. No. 09/088,127 entitled "Fuel Injector with Internal Heater" filed on Jun. 1, 1998; U.S. provisional patent application serial No. 60/122,162 entitled "A Method of Using an Internally Heated Tip Injector to Reduce Hydrocarbon Emissions During Cold-Start" filed on Feb. 26, 1999; and U.S. Pat. No. 5,758,826. The aforementioned three U.S. patent applications and one U.S. patent are hereby expressly incorporated by reference.

U.S. patent application Ser. No. 09/088,126 describes an electronic circuit for driving a heated tip injector having a two-pin connector. The electronic circuit alternately drives the injector coil and heater. U.S. Pat. No. 5,758,826 discloses a heated tip injector having a connector with more than two pins, in particular, three pins. The present invention is a method and apparatus for controlling a heated tip injector having a connector with more than two pins.

SUMMARY OF THE INVENTION

It is an object of the invention to provide a method and apparatus for controlling a heated tip injector having a connector with more than two pins.

It is another object of the invention to provide a method and apparatus for controlling a heated tip injector wherein the voltage drop across the injector coil is minimized.

It is a further object of the invention to provide a method and apparatus for controlling a heated tip injector wherein the heater is switched in a time delayed or pulse-reversed manner to the injector coil pulses.

These and other objects of the invention are achieved in a first embodiment by a method of controlling heated tip injectors in an engine comprising (a) providing a plurality of heated tip injectors each having a coil and an internal heater; (b) maintaining all the internal heaters in an OFF state while the engine is cranking; (c) maintaining an internal heater in an OFF state if its respective coil is ON; and (d) maintaining an internal heater in an ON state if the engine is not cranking and the internal heater's respective coil is OFF. The first embodiment may also comprise (e) maintaining all the internal heaters in an OFF state after a predetermined time.

A first embodiment of an apparatus for controlling heated tip injectors in an engine comprises a plurality of heated tip injectors each having a coil and an internal heater; a power supply; an ignition switch connected to the power supply, one end of each coil and heater being connected together and to the ignition switch; an engine electronic control unit, another end of each coil being connected to the engine electronic control unit; means for switching each internal heater ON and OFF, another end of each internal heater being connected through a respective means for switching to ground; a crank circuit including a crank for cranking the engine; and means for isolating the crank circuit from the engine electronic control unit.

A second embodiment of a method of controlling heated tip injectors in an engine comprises (a) providing a plurality of heated tip injectors each having a coil and an internal heater; (b) maintaining all the internal heaters in an OFF state while the engine is cranking; (c) maintaining an internal heater in an OFF state if its respective coil is ON; (d) enabling a first internal heater after the engine stops cranking; (e) enabling remaining internal heaters sequentially with a time delay between enablement of each internal heater; and (f) maintaining an internal heater in an ON state if the engine is not cranking, the internal heater's respective coil is OFF and the internal heater has been enabled.

A second embodiment of an apparatus for controlling heated tip injectors in an engine comprises a plurality of heated tip injectors each having a coil and an internal heater; a power supply; an ignition switch connected to the power supply, one end of each coil and heater being connected together and to the ignition switch; an engine electronic control unit, another end of each coil being connected to the engine electronic control unit; means for switching each internal heater ON and OFF, another end of each internal heater being connected through a respective means for switching to ground; a crank for cranking the engine; and means for providing a time delay for sequentially enabling the internal heaters.

A third embodiment of a method of controlling heated tip injectors in an engine comprises (a) providing a plurality of heated tip injectors each having a coil and an internal heater; (b) maintaining all the internal heaters in an OFF state while the engine is cranking; (c) maintaining all the internal heaters in an OFF state if any coil is ON; and (d) maintaining an internal heater in an ON state if the engine is not cranking and no coil is ON.

A third embodiment of an apparatus for controlling heated tip injectors in an engine comprises a plurality of heated tip injectors each having a coil and an internal heater; a power supply; an ignition switch connected to the power supply, one end of each coil and heater being connected together and to the ignition switch; an engine electronic control unit, another end of each coil being connected to the engine electronic control unit; means for switching each internal heater ON and OFF, another end of each internal heater being connected through a respective means for switching to ground; a crank for cranking the engine; and means for maintaining all the internal heaters in an OFF state while the engine is cranking, maintaining all the internal heaters in an OFF state if any coil is ON and maintaining an internal heater in an ON state if the engine is not cranking and no coil is ON.

A fourth embodiment of a method of controlling heated tip injectors in an engine comprises (a) providing a plurality of heated tip injectors each having a coil and an internal heater; (b) maintaining all the internal heaters in an OFF state while the engine is cranking; (c) turning all internal heaters ON when current in any injector coil reaches a point at which its injector needle is completely open; and (d) turning all internal heaters OFF prior to any coil receiving a new coil pulse.

A fourth embodiment of an apparatus for controlling heated tip injectors in an engine comprises a plurality of heated tip injectors each having a coil and an internal heater; a power supply; an ignition switch connected to the power supply, one end of each coil and heater being connected together and to the ignition switch; an engine electronic control unit, another end of each coil being connected to the engine electronic control unit; means for switching each internal heater ON and OFF, another end of each internal heater being connected through a respective means for switching to ground and the electronic control unit; wherein the engine electronic control unit is programmed such that all the internal heaters are in an OFF state while the engine is cranking, all internal heaters are ON when current in any injector coil reaches a point at which its injector needle is completely open and all internal heaters are OFF prior to any coil receiving a new coil pulse.

A fifth embodiment of a method of controlling heated tip injectors in an engine comprises (a) providing a plurality of heated tip injectors each having a coil and an internal heater; and (b) turning the internal heaters ON at any time an ignition switch of the engine is closed, irrespective of a state of the coils.

A fifth embodiment of an apparatus for controlling heated tip injectors in an engine comprises a plurality of heated tip injectors each having a coil and an internal heater; a first power supply connected to the heaters and a second power supply connected to the coils; an ignition switch connected to one of the power supplies; an engine electronic control unit, one end of each coil being connected to the engine electronic control unit; and means for switching the internal heaters ON and OFF, one end of each internal heater being connected through a respective means for switching to the engine electronic control unit.

Further objects, features and advantages of the invention will become apparent from the following detailed description taken in conjunction with the drawing.

DETAILED DESCRIPTION OF THE PREFERRED EMBODIMENTS

The present invention is a method and apparatus for controlling a heated tip injector. Specifically, the invention is directed to controlling a heated tip injector having a connector with more than two pins.

In the design of a three-pin connector for a heated tip injector, both positive sides or both negative sides of the injector coil and heater need to be connected inside of the injector housing. Therefore, the coil and the heater are electrically coupled in such an arrangement. Because the coil of a fuel injector is controlled on the negative side in an electrical circuit in engine applications, the heater of the heated tip injector has to be controlled on the negative side as well.

An injector coil and heater can be driven with two separate electrical circuits in a four-pin arrangement of a heated tip injector. However, using the same energy source, both circuits would be connected through the internal resistance of the energy source.

Because the heater of the heated tip injector consumes a significant amount of current during start-up, a voltage drop across the energy source, as well as across the internal resistance of the wiring and connectors in the electrical circuit occurs. As a result, the voltage will drop across the injector coil, and influence the dynamic flow of a fuel injector. The present invention seeks to minimize the effect that operation of the heater has on the dynamic flow of the injector.

Figure 1:
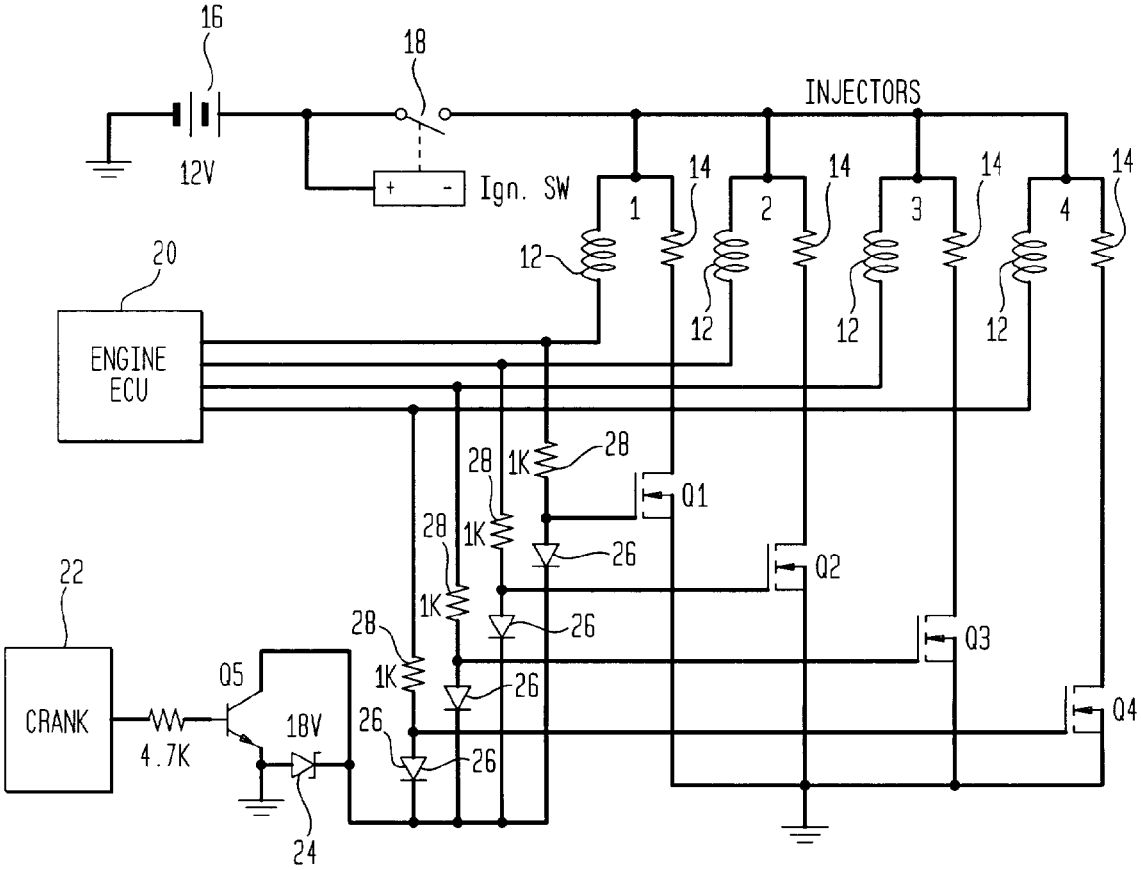
FIG. 1 is a schematic of one embodiment of an electrical circuit for controlling a heated tip injector.
Figure 2:
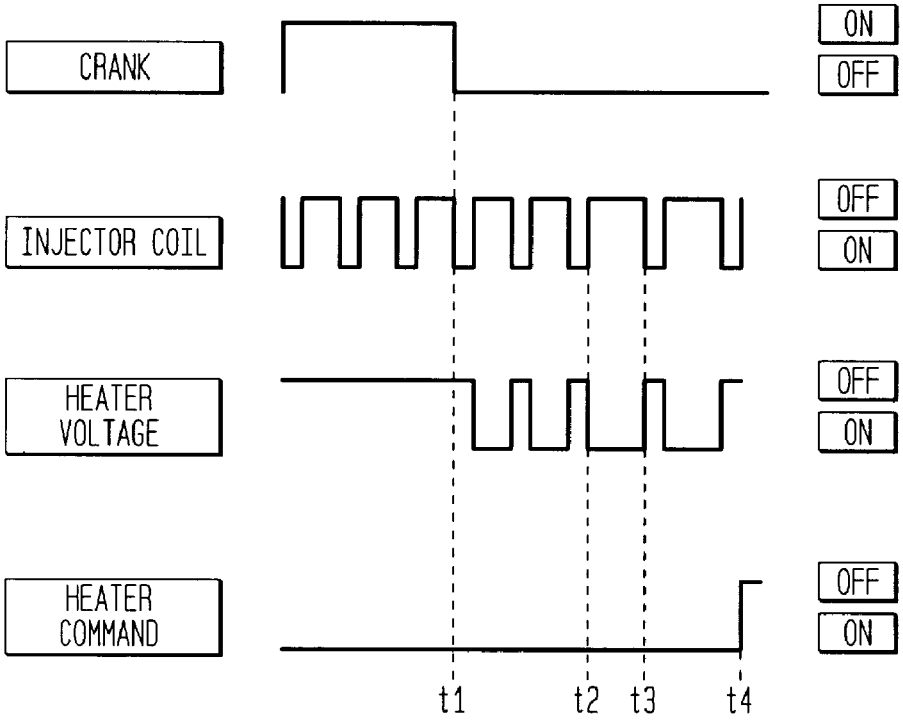
FIG. 2 shows the ON-OFF relationship of the injector coils and heaters of the circuit shown in FIG. 1.

FIG. 1 is an electrical schematic of a first embodiment of the invention. FIG. 2 shows the ON-OFF diagrams for the coils and heaters shown in FIG. 1. Throughout the Figures, like reference numerals refer to like components.

FIG. 1 shows a hardware circuit that provides a pulse-reversed switching of the heater and injector coil. Injectors 1,2,3,4 each include a coil 12 and an internal heater 14. Both the coil 12 and heater 14 of each injector 1,2,3,4 are connected together to the power supply 16 through the ignition switch 18. The ground side of each injector coil 12 is connected to the electronic control unit (ECU) 20, where the driver pulses for each coil 12 are generated. The injectors in FIG. 1 each have a three pin connector. One pin connects to the ignition switch 18, one pin from the coil 12 to the ECU and the third pin from the heater 14 to the MOSFETs Q1–Q4, respectively. Alternatively, for a four pin injector, the coil 12 and heater 14 can be connected to separate pins.

Each heater 14 is connected through a means for switching the heater ON and OFF to ground. In the disclosed circuit, the means for switching are single gate enhancement mode MOSFETs Q1,Q2,Q3,Q4, respectively. Other means for switching could be used. Crank 22 is connected to the circuit through NPN transistor Q5 and zener diode 24. A means for isolating the crank circuit from the ECU comprises, for example, four diodes 26. Current limiting resistors 28 are provided between the diodes 26 and the ECU. The circuit shown in FIG. 1 for a four-cylinder engine may be extended in the same way for a six, eight, or twelve-cylinder engine.

Referring now to FIG. 2, if the injector coil 12 of an injector is turned ON, the respective heater 14 is turned OFF because the respective transistors, Q1 to Q4, are turned OFF. If the engine is cranking, all heaters 14 will be turned OFF. When cranking, transistor Q5 is turned ON and, therefore, transistors Q1 to Q4 are turned OFF. As shown in FIG. 2, the crank goes OFF at t1 when the engine starts, that is, when the engine reaches a few hundred RPM, for example, 300–600 RPM. The heater command goes OFF after a predetermined time t4 which may be, for example, catalyst light-off. As shown between t2 and t3, each heater 14 is OFF when its respective coil 12 is ON. However, it is possible that the coil 12 of one injector may be ON and the heater 14 of another injector may also be ON.

Figure 3:
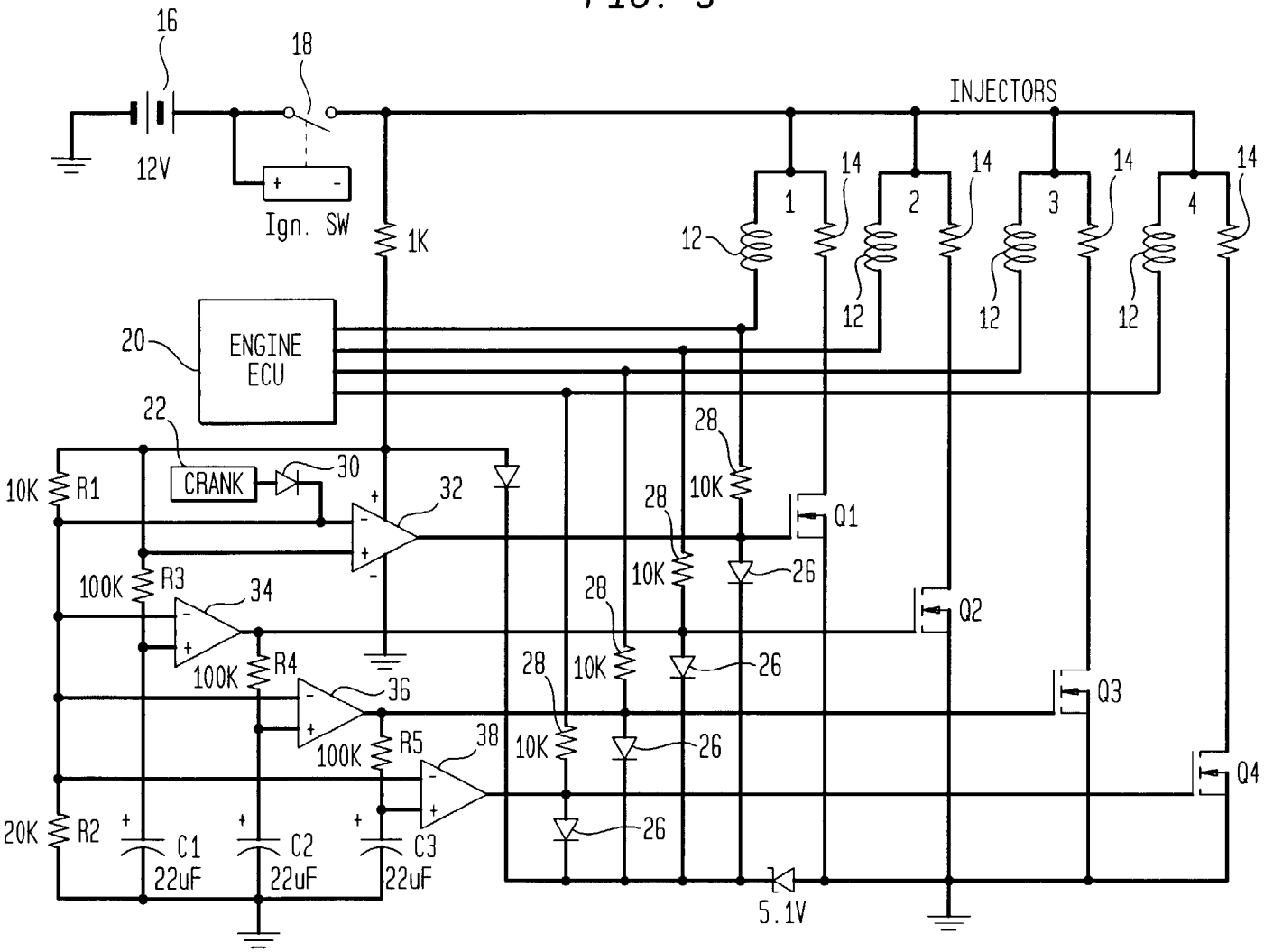
FIG. 3 is a schematic of a second embodiment of an electrical circuit for controlling a heated tip injector.
Figure 4:
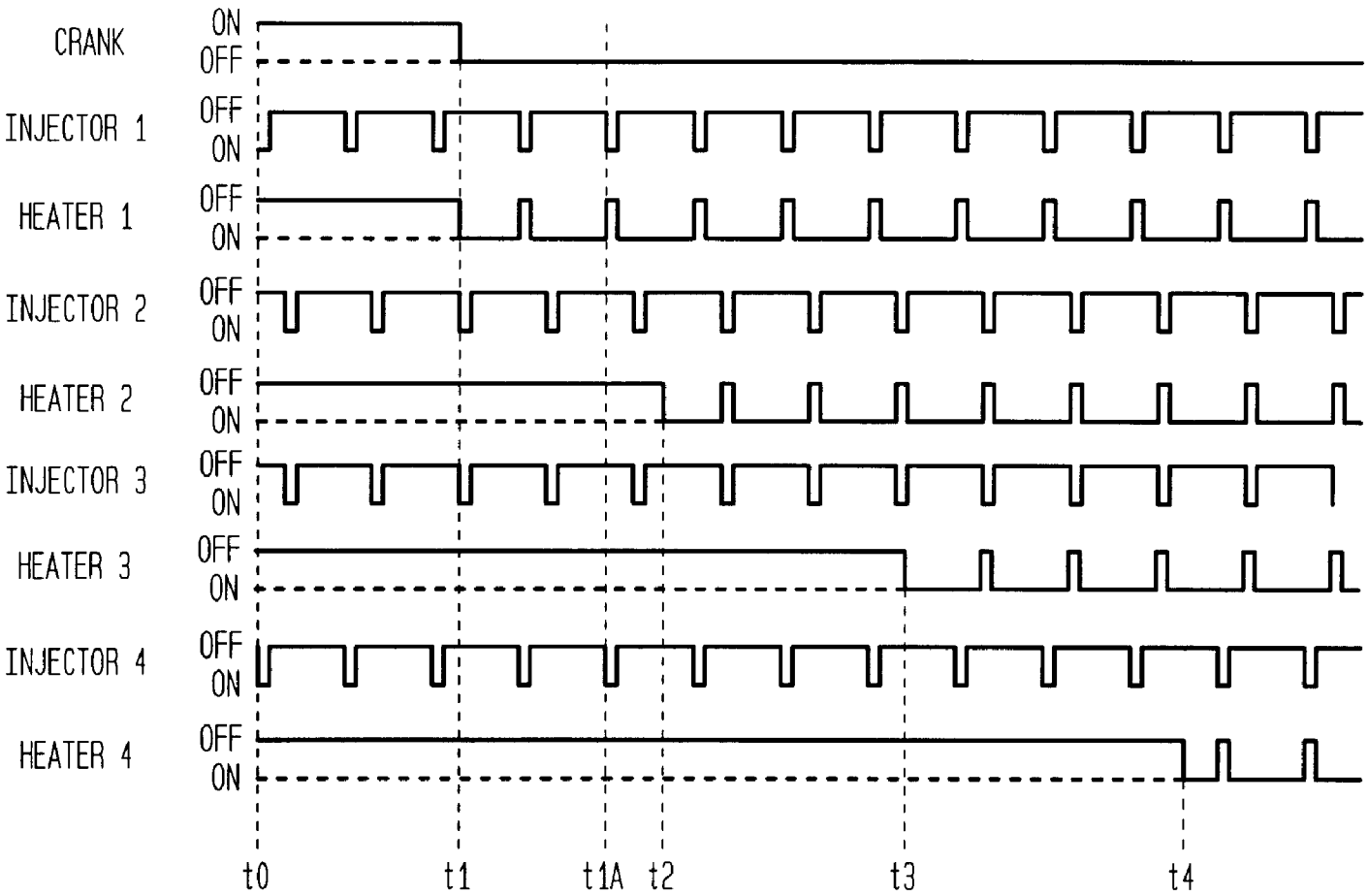
FIG. 4 shows the ON-OFF relationship of the injector coils and heaters of the circuit shown in FIG. 3.

FIG. 3 is an electrical schematic of a second embodiment of the invention. FIG. 4 shows the ON-OFF diagrams for the coils and heaters shown in FIG. 3.

In the embodiment shown in FIG. 3, the initial application of the heaters 14 is time delay sequenced. The basic control of the heaters 14 and injector coils 12 shown in FIG. 3 is based on the same principle as described in FIG. 1. Injectors 1,2,3,4 each include a coil 12 and an internal heater 14. Both the coil 12 and heater 14 of each injector 1,2,3,4 are connected together to the power supply 16 through the ignition switch 18. The ground side of each injector coil 12 is connected to the electronic control unit (ECU) 20, where the driver pulses for each coil 12 are generated. The injectors in FIG. 3 each have a three pin connector. One pin connects to the ignition switch 18, one pin from the coil 12 to the ECU and the third pin from the heater 14 to the MOSFET Q1–Q4, respectively. Alternatively, for a four pin injector, the coil 12 and heater 14 can be connected to separate pins.

Each heater 14 is connected through a means for switching the heater ON and OFF to ground. In the disclosed circuit, the means for switching are single gate enhancement mode MOSFETs Q1,Q2,Q3,Q4, respectively. Other means for switching could be used. Crank 22 is connected to the circuit through diode 30 and comparator 32. A means for isolating the crank circuit from the ECU comprises, for example, four diodes 26. Current limiting resistors 28 are provided between the diodes 26 and the ECU.

Resistors R1, for example 10 K, and R2, for example 20 K, establish a reference voltage for the comparators 32,34, 36,38. The circuit includes means for providing a time delay for sequentially enabling the internal heaters. In the disclosed circuit, the means for providing a time delay includes RC circuits comprising resistors R3,R4,R5 and capacitors C1,C2,C3, respectively. The resistors R3,R4,R5 and capacitors C1,C2,C3 are connected through comparators 34,36,38, respectively, to heaters 14 of injectors 2,3, and 4. The circuit shown in FIG. 3 for a four-cylinder engine may be extended in the same way for a six, eight, or twelve-cylinder engine.

As shown in FIG. 4, a heater 14 is ON when its respective injector coil 14 is OFF.

All the heaters 14 are turned OFF when the engine is cranking from t0 to t1. The controller of FIG. 3 differs from the controller of FIG. 1 in that the heaters 14 are initially enabled in a time delayed sequence controlled by the RC time constant. The heater of injector 1 is enabled immediately at t1, followed by the heater of injector 2 two seconds later at t2, followed by the heater of injector 3 two more seconds later at t3, followed by the heater of injector 4 two more seconds later at t4, for a total sequence time of six seconds. The delay time may be changed by changing the value of the resistors R3,R4,R5 (shown in FIG. 3 as 100 K). As shown between times t1 and t1A, each of the coils of injectors 1,2,3,4 is in an OFF state for part of the time period. However, because of the time delay, only the heater of injector 1 reaches an ON state. An important difference between the embodiment of FIG. 3 and the embodiment of FIG. 1 is that the heaters 14 in the embodiment of FIG. 3 are turned on in a sequential manner, thereby reducing the amount of current needed during startup.

Figure 5:
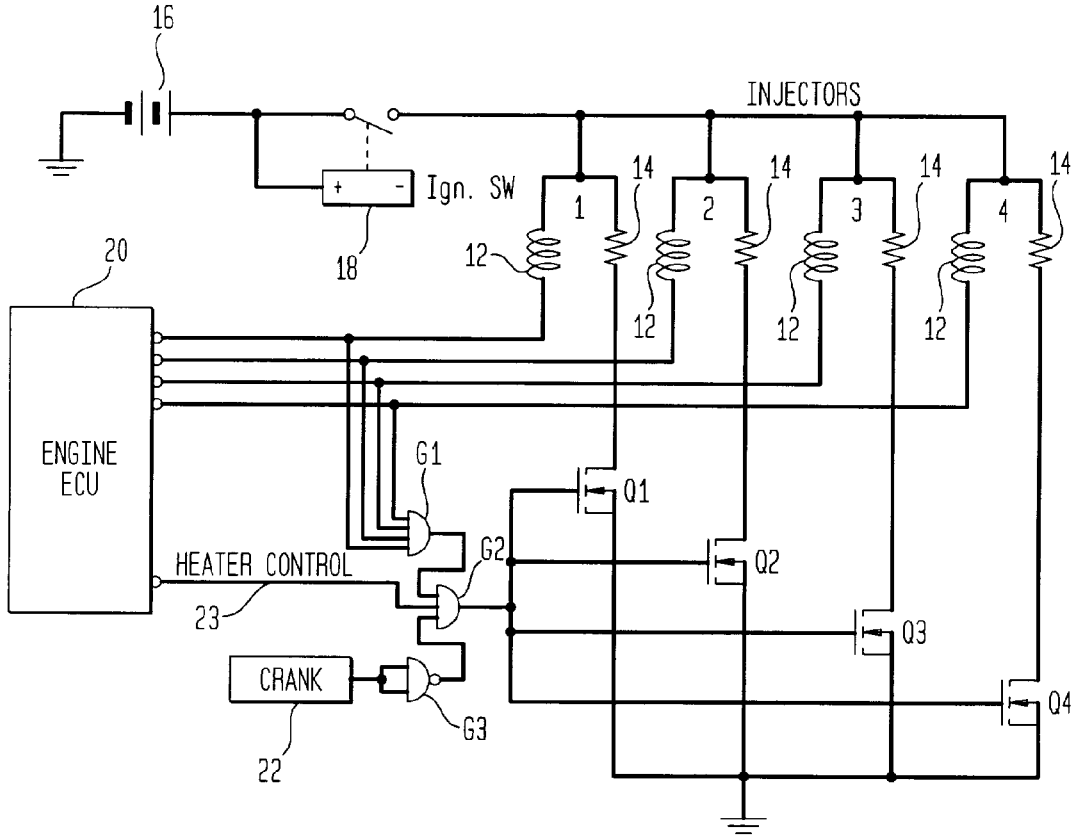
FIG. 5 is a schematic of a third embodiment of an electrical circuit for controlling a heated tip injector.
Figure 6:
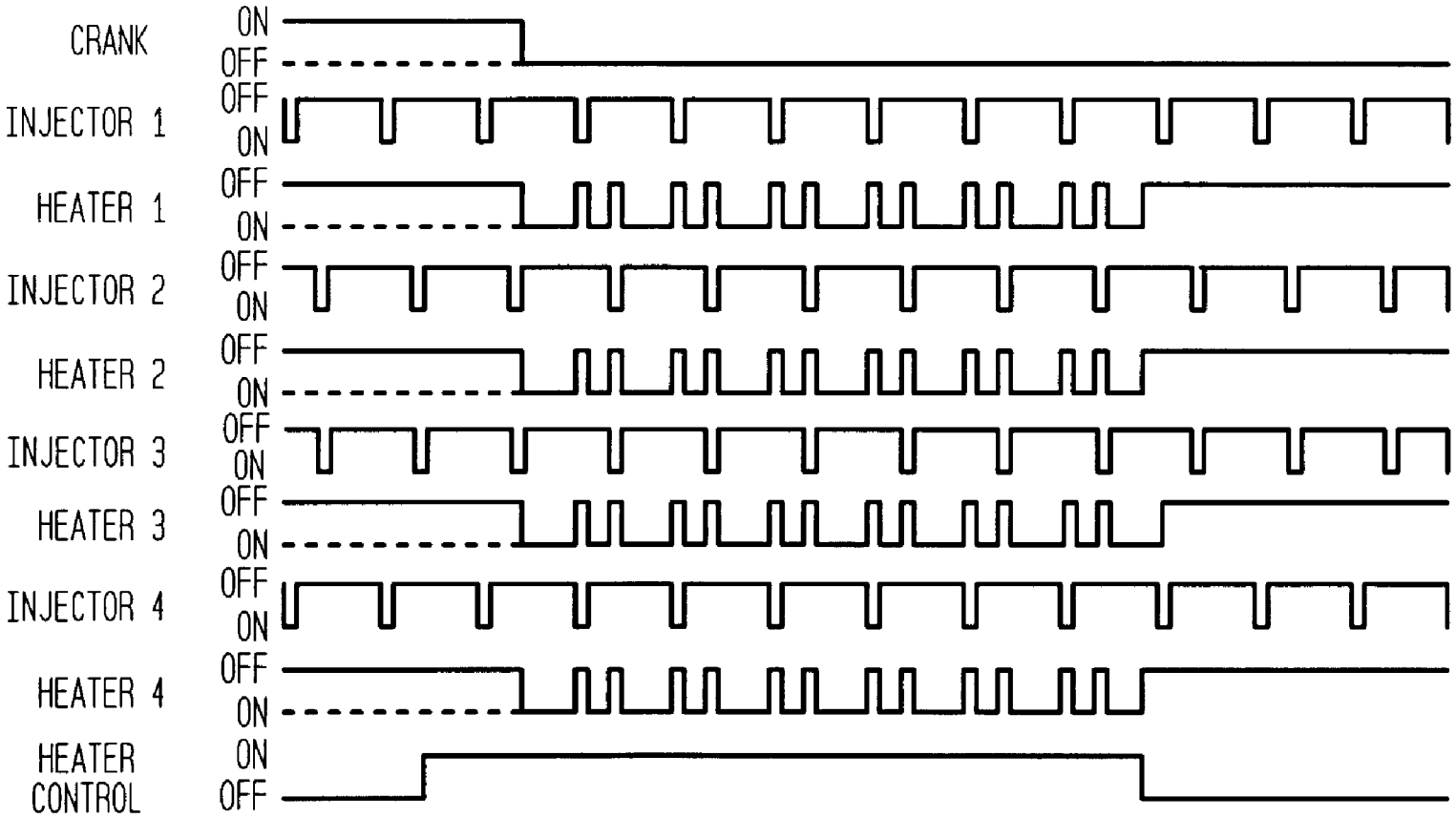
FIG. 6 shows the ON-OFF relationship of the injector coils and heaters of the circuit shown in FIG. 5.

FIG. 5 is an electrical schematic of a third embodiment of the invention. FIG. 6 shows the ON-OFF diagrams for the coils and heaters shown in FIG. 5.

In FIG. 5, injectors 1,2,3,4 each include a coil 12 and an internal heater 14. Both the coil 12 and heater 14 of each injector 1,2,3,4 are connected together to the power supply 16 through the ignition switch 18. The ground side of each injector coil 12 is connected to the electronic control unit (ECU) 20, where the driver pulses for each coil 12 are generated. The injectors in FIG. 5 each have a three-pin connector. One pin connects to the ignition switch 18, one pin from the coil 12 to the ECU and the third pin from the heater 14 to means for switching the internal heaters ON and OFF. In the disclosed circuit, the means for switching the internal heaters ON and OFF are MOSFETs Q1–Q4, respectively. Alternatively, for a four pin injector, the coil 12 and heater 14 can be connected to separate pins.

The circuit in FIG. 5 includes means for maintaining all the internal heaters in an OFF state while the engine is cranking; maintaining all the internal heaters in an OFF sate if any coil is ON; and maintaining an internal heater in an ON state if the engine is not cranking and no coil is ON. The disclosed means are logic gates G1–G3. Gates G1 and G2 are AND gates and gate G3 is a NAND gate. The crank 22 receives voltage signals (5 volts) from the ECU 20. The heater command control 23 is a 5-volt signal from the ECU 20. Gate G1 monitors the voltage level in the four injector coils 12 and provides an input to gate G2. An AND function is performed at gate G2, and gate G3 is used as a signal inverter. Different gate arrangements or a custom integrated circuit may be employed to achieve the same logic control. The circuit shown in FIG. 5 for a four-cylinder engine may be extended in the same way for a six, eight, or twelve-cylinder engine.

As shown in FIG. 6, the circuit of FIG. 5 turns OFF all the heaters 14 if any of the injector coils 12 are turned ON, if the crank 22 is in an ON state or if the heater control 23 is in an OFF state. The ECU 20 provides the heater control 23 request and delay strategy.

There are three main differences between the embodiment of FIG. 5 and the embodiments of FIGS. 1 and 3. First, the circuits of FIGS. 1 and 3 only control the heater 14 associated with the corresponding injector. That is, the state of the injector coil in one injector does not affect the state of the heater in a separate injector. However, in the circuit of FIG. 5, the circuit has control over all of the heaters of all the injectors. Therefore the current load of the heaters has no effect on the coil current of any of the injectors. The state of any of the injector coils 12 will affect the state of all the heaters 14. Second, in the circuit of FIG. 3, the heaters 14 are turned ON in a sequential manner about two seconds apart. Third, in the circuit of FIG. 5 the heater command signal 24 is realized through a software control inside the ECU 20.

Figure 7:
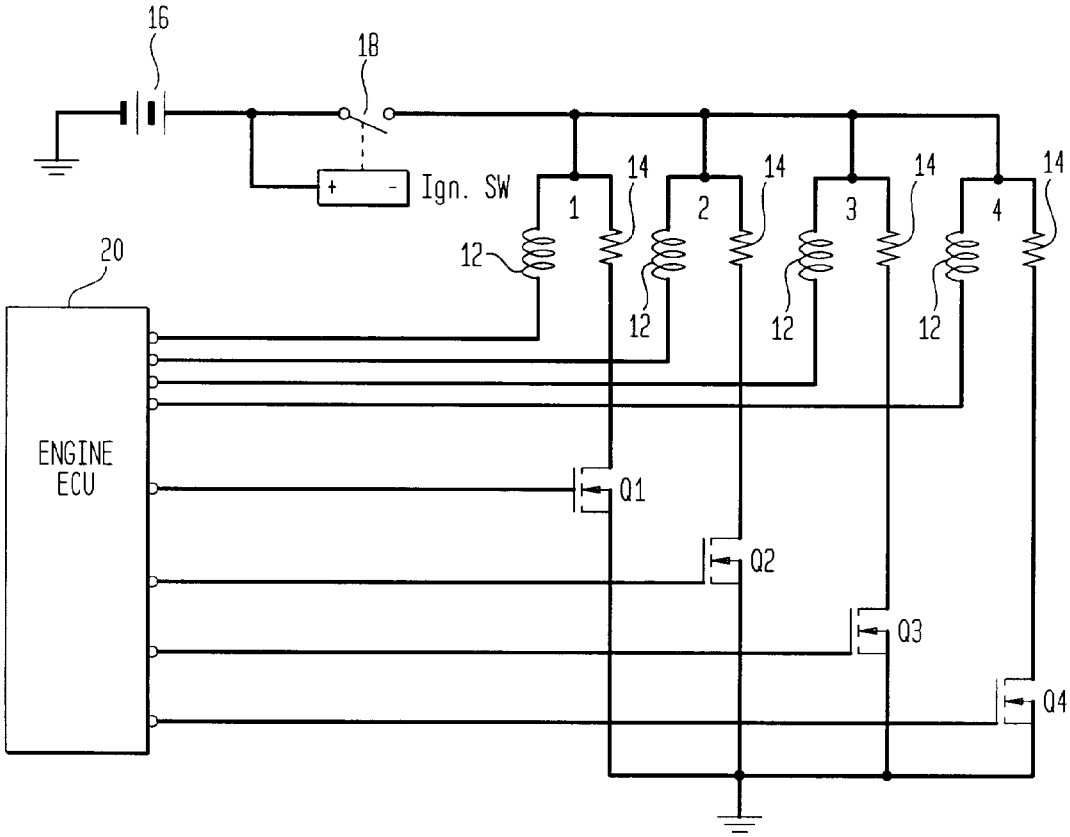
FIG. 7 is a schematic of a fourth embodiment of an electrical circuit for controlling a heated tip injector.
Figure 8:
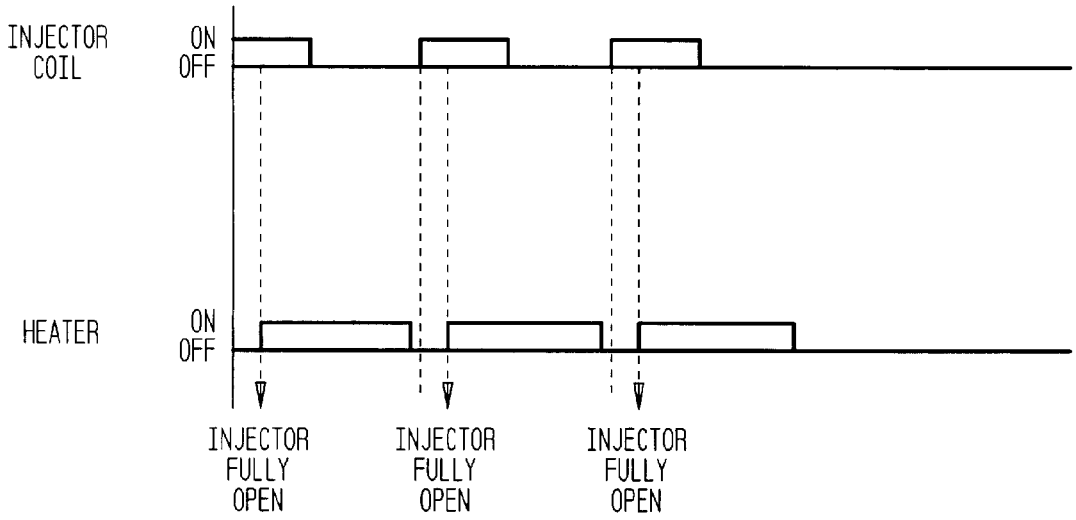
FIG. 8 shows the ON-OFF relationship of the injector coils and heaters of the circuit shown in FIG. 7.

FIG. 7 is an electrical schematic of a fourth embodiment of the invention. FIG. 8 shows ON-OFF diagrams for the coils and heaters shown in FIG. 7.

In FIG. 7, injectors 1,2,3,4 each include a coil 12 and an internal heater 14. Both the coil 12 and heater 14 of each injector 1,2,3,4 are connected together to the power supply 16 through the ignition switch 18. The ground side of each injector coil 12 is connected to the electronic control unit (ECU) 20, where the driver pulses for each coil 12 are generated. The injectors in FIG. 5 each have a three-pin connector. One pin connects to the ignition switch 18, one pin from the coil 12 to the ECU and the third pin from the heater 14 to means for switching the internal heaters ON and OFF. In the disclosed circuit, the means for switching the internal heaters ON and OFF are MOSFETs Q1–Q4, respectively. Alternatively, for a four pin injector, the coil 12 and heater 14 can be connected to separate pins. The circuit shown in FIG. 7 for a four-cylinder engine may be extended in the same way for a six, eight, or twelve-cylinder engine.

In FIG. 7, the heater time delay is realized through a software control inside the ECU. As shown in FIG. 8, the heater current is turned ON right after the coil current reaches a level at which the injector needle is completely open. The heater current is turned OFF shortly before the next injector coil pulse is generated. Because all information about ignition, battery voltage, cranking of the engine and injector pulse per cylinder are known parameters in the ECU, the heater current may be controlled cylinder selective and dependent on environmental conditions. The ECU may be programmed as desired to control the heaters 14.

Figure 9:
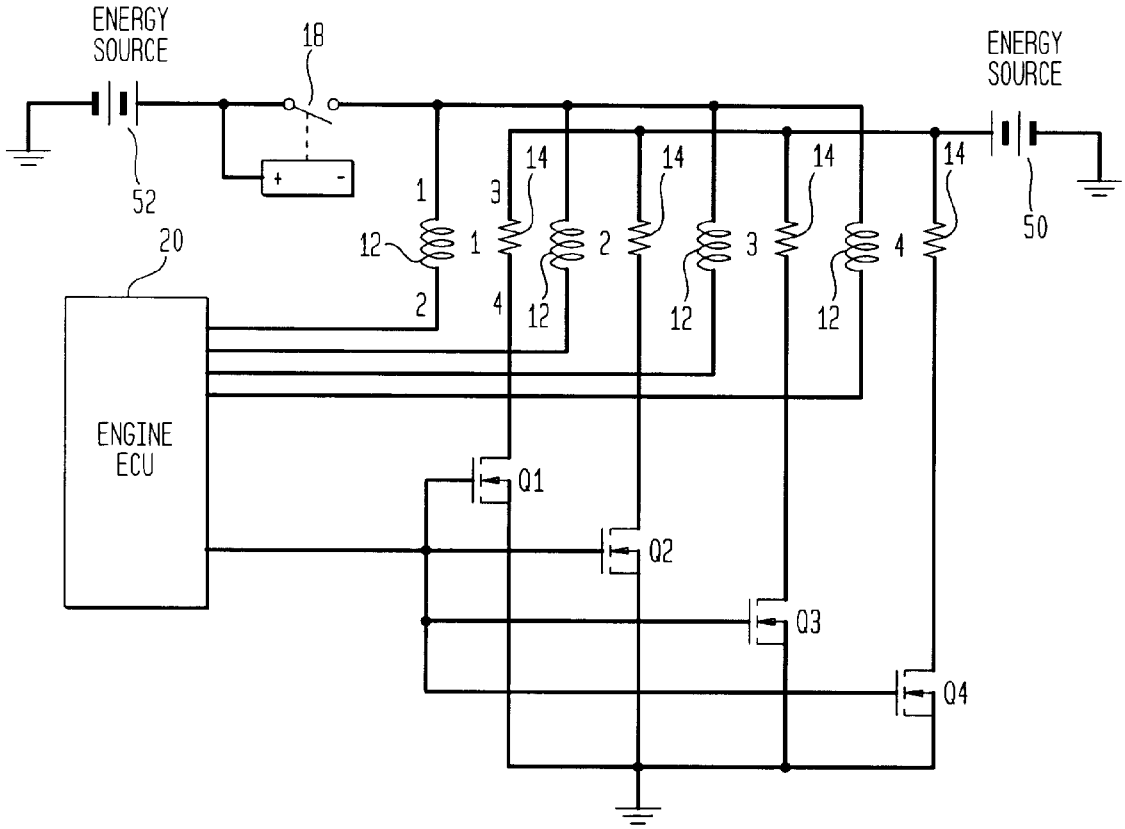
FIG. 9 is a schematic of a fifth embodiment of an electrical circuit for controlling a heated tip injector.

FIG. 9 is a schematic of a fifth embodiment of an electrical circuit for controlling a heated tip injector. In the circuit of FIG. 9 the heaters 14 and injector coils 12 are driven by two separate energy sources 50, 52, respectively. A four-pin connector for the heated tip injector is necessary for such an arrangement. Each side of a coil 12 is connected to a separate pin and each side of a heater 14 is connected to a separate pin. The ECU 20 may be programmed to control the heaters and coils in any manner. Each heater 14 and coil 12 can be turned ON simultaneously or be controlled as described in any one of the preceding four embodiments. Means for switching the internal heaters ON and OFF may be, for example, MOSFETs Q1–Q4, respectively. Alternatively, the means for switching the internal heaters ON and OFF may be a simple relay connected between the ECU 20 and the heaters 14. The circuit shown in FIG. 9 for a four-cylinder engine may be extended in the same way for a six, eight, or twelve-cylinder engine.

Figure 10:
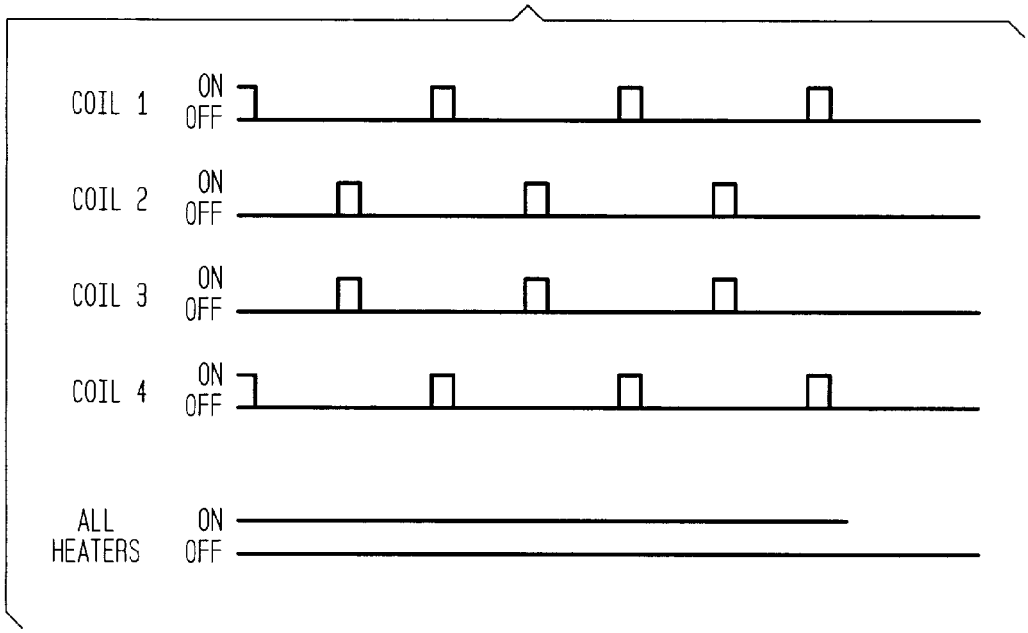
FIG. 10 shows the ON-OFF relationship of the injector coils and heaters of the circuit shown in FIG. 9.

FIG. 10 shows an exemplary ON-OFF relationship of the injector coils and heaters of the circuit shown in FIG. 9. As shown in FIG. 10, the heaters 14 may be controlled independently of the state of any coil 12.

While the invention has been described with reference to certain preferred embodiments, numerous changes, alterations and modifications to the described embodiments are possible without departing from the spirit and scope of invention as defined in the appended claims, and equivalents thereof.

What is claimed is:

1. An apparatus for controlling heated tip injectors in an engine comprising:

a plurality of heated tip injectors each having a coil and an internal heater;

a power supply;

an ignition switch connected to the power supply, one end of each coil and heater being connected together and to the ignition switch;

an engine electronic control unit, another end of each coil being connected to the engine electronic control unit;

means for switching each internal heater ON and OFF, another end of each internal heater being connected through a respective means for switching to ground;

a crank circuit including a crank for cranking the engine; and means for isolating the crank circuit from the engine electronic control unit.

2. A method of controlling heated tip injectors in an engine comprising:

(a) providing a plurality of heated tip injectors each having a coil and an internal heater;

(b) maintaining all the internal heaters in an OFF state while the engine is cranking;

(c) maintaining all the internal heaters in an OFF state if any coil is ON; and (d) maintaining an internal heater in an ON state if the engine is not cranking and no coil is ON.

3. The method of claim 2 further comprising (e) a predetermined time after engine start, maintaining each internal heater in an ON or OFF state without regard to whether or not any coil is ON.

4. An apparatus for controlling heated tip injectors in an engine comprising:

a plurality of heated tip injectors each having a coil and an internal heater;

a power supply;

an ignition switch connected to the power supply, one end of each coil and heater being connected together and to the ignition switch;

an engine electronic control unit, another end of each coil being connected to the engine electronic control unit;

means for switching each internal heater ON and OFF, another end of each internal heater being connected through a respective means for switching to ground;

a crank for cranking the engine; and means for maintaining all the internal heaters in an OFF state while the engine is cranking, maintaining all the internal heaters in an OFF state if any coil is ON and maintaining an internal heater in an ON state if the engine is not cranking and no coil is ON.

* * * * *